US008671671B1

(12) United States Patent
Spencer-Smith et al.

(10) Patent No.: US 8,671,671 B1
(45) Date of Patent: Mar. 18, 2014

(54) EXHAUST SYSTEM FOR AN INTERNAL COMBUSTION ENGINE

(75) Inventors: Michael Spencer-Smith, Napa, CA (US); Louis Walch, American Canyon, CA (US)

(73) Assignee: Northern California Diagnostic Laboratories, Napa, CA (US)

( * ) Notice: Subject to any disclaimer, the term of this patent is extended or adjusted under 35 U.S.C. 154(b) by 1 day.

(21) Appl. No.: 13/609,489

(22) Filed: Sep. 11, 2012

Related U.S. Application Data

(63) Continuation-in-part of application No. 13/135,777, filed on Jul. 14, 2011.

(51) Int. Cl.
*F01N 1/00* (2006.01)

(52) U.S. Cl.
USPC ..... 60/324

(58) Field of Classification Search
USPC ..... 60/324
See application file for complete search history.

(56) References Cited

U.S. PATENT DOCUMENTS

| | | | | |
|---|---|---|---|---|
| 2,716,463 | A | 8/1955 | Latulippe | |
| 3,710,891 | A * | 1/1973 | Flugger | 181/256 |
| 3,765,505 | A * | 10/1973 | Pendleton | 181/200 |
| 3,897,229 | A | 7/1975 | Lada | |
| 4,027,636 | A * | 6/1977 | Yamamoto et al. | 123/568.19 |
| 4,098,174 | A | 7/1978 | Landy | |
| 4,361,206 | A * | 11/1982 | Tsai | 181/255 |
| 4,589,515 | A | 5/1986 | Omura | |
| 4,673,058 | A | 6/1987 | Roberts et al. | |
| 4,690,245 | A * | 9/1987 | Gregorich et al. | 181/272 |
| 4,792,014 | A | 12/1988 | Shin-Seng | |
| 4,909,034 | A * | 3/1990 | Kakuta | 60/324 |
| 5,173,576 | A | 12/1992 | Feuling | |
| 5,371,331 | A | 12/1994 | Wall | |
| 5,563,382 | A | 10/1996 | Choyce | |
| 6,105,716 | A * | 8/2000 | Morehead et al. | 181/255 |
| 6,283,246 | B1 | 9/2001 | Nishikawa | |
| 6,520,285 | B2 | 2/2003 | Tobias | |
| 6,554,100 | B2 | 4/2003 | Kim | |
| 6,688,425 | B2 | 2/2004 | Cole et al. | |
| 6,810,992 | B1 | 11/2004 | Lombardo | |
| 7,487,633 | B2 * | 2/2009 | Popik et al. | 60/289 |
| 7,549,512 | B2 * | 6/2009 | Newberry | 181/281 |
| 7,552,797 | B2 | 6/2009 | Luttig | |
| 7,614,222 | B2 * | 11/2009 | Hemingway et al. | 60/324 |
| 7,631,725 | B2 | 12/2009 | Towne et al. | |
| 7,645,432 | B1 * | 1/2010 | Solomon | 423/212 |
| 7,698,889 | B1 | 4/2010 | Burk et al. | |
| 7,805,932 | B2 | 10/2010 | Oxborrow | |
| 2005/0161283 | A1 | 7/2005 | Emler | |
| 2006/0225951 | A1 * | 10/2006 | Mavinahally et al. | 181/264 |
| 2007/0051557 | A1 * | 3/2007 | Chang | 181/252 |
| 2008/0245606 | A1 * | 10/2008 | Wu | 181/256 |
| 2009/0101434 | A1 | 4/2009 | Sammut et al. | |
| 2009/0283358 | A1 | 11/2009 | Hughey | |
| 2010/0126155 | A1 * | 5/2010 | Garcia et al. | 60/317 |
| 2010/0300413 | A1 * | 12/2010 | Ulrey et al. | 123/518 |
| 2011/0120432 | A1 * | 5/2011 | Ulrey et al. | 123/568.15 |

* cited by examiner

*Primary Examiner* — Thomas Denion
*Assistant Examiner* — Jason Shanske
(74) *Attorney, Agent, or Firm* — Thomas R. Lampe

(57) ABSTRACT

An exhaust system for an internal combustion engine including an elongated tube for receiving exhaust gas and exhaust flow modification structure within the tube interior configured to cooperate with the elongated tube to produce a laminar flow of exhaust gas and modify the flow speed of the exhaust gas due to the venturi effect. The exhaust system includes two spaced structural components which form restricted a annular flow path to enhance the venturi effect.

11 Claims, 5 Drawing Sheets

40
42

42
40

40

42
40

42
40
10
12

10
42
40
12

50
52

60
52
58
64
50
54
62

50
54

50
52
54

52
54
50

10
12
50

71
81
81
67
75
83
83
73

10
12
50
58

EXHAUST SYSTEM FOR AN INTERNAL COMBUSTION ENGINE

This application is a continuation-in-part of U.S. patent application Ser. No. 13/135,777, filed Jul. 14, 2011.

TECHNICAL FIELD

This invention relates to an exhaust system for an internal combustion engine. The invention is applicable to all internal combustion engines but has particular, but not-exclusive, application to internal combustion engines of motorcycles or other vehicles.

BACKGROUND OF THE INVENTION

In exhaust systems for internal combustion engines it is desirable to optimize velocity of exhaust flow to enhance engine performance. Turbulence in the exhaust flow and consequent build up of back pressure in the system is a major impediment to maximizing internal combustion engine performance. Poor performance of internal combustion engines employed with motorcycles and other vehicles, among other adverse consequences, results in failure of the vehicle to reach otherwise attainable speeds.

The following prior art having some degree of relevance to the present invention is known: U.S. Pat. No. 7,552,797, issued Jun. 30, 2009, U.S. Pat. No. 6,810,992, issued Nov. 2, 2004, U.S. Pat. No. 6,688,425, issued Feb. 10, 2004, U.S. Pat. No. 6,554,100, issued Apr. 29, 2003, U.S. Pat. No. 6,520,285, issued Feb. 18, 2003, U.S. Pat. No. 6,283,246, issued Sep. 4, 2001, U.S. Pat. No. 5,563,382, issued Oct. 8, 1996, U.S. Pat. No. 5,371,331, issued Dec. 6, 1994, U.S. Pat. No. 5,173,576, issued Dec. 22, 1992, U.S. Pat. No. 4,792,014, issued Dec. 20, 1988, U.S. Pat. No. 4,589,515, issued May 20, 1986, U.S. Pat. No. 2,716,463, issued Aug. 30, 1955, U.S. Patent App. Pub. No. US 2009/0283358, published Nov. 19, 2009, U.S. Patent App. Pub. No. US 2009/0101434, published Apr. 23, 2009, U.S. Patent App. Pub. No. US 2005/0161283, published Jul. 28, 2005, U.S. Pat. No. 7,805,932, issued Oct. 5, 2010, U.S. Pat. No. 7,631,725, issued Dec. 15, 2009, U.S. Pat. No. 3,897,229, issued Jul. 29, 1975, U.S. Pat. No. 4,098,174, issued Jul. 4, 1978, U.S. Pat. No. 7,698,889, issued Apr. 20, 2010 and U.S. Pat. No. 4,673,058, issued Jun. 16, 1987.

The above-identified prior art relates to various exhaust systems which incorporate structure affecting exhaust flow. The prior art does not teach or suggest the apparatus or method of the exhaust system disclosed and claimed herein.

DISCLOSURE OF INVENTION

As will be described in greater detail below, the present invention improves exhaust gas flow by producing a laminar flow of the exhaust gas and modifying the flow speed of the exhaust gas due to the venturi effect.

The subject exhaust system includes an elongated tube defining a tube interior for receiving exhaust gas from an internal combustion engine.

Exhaust flow modification structure is disposed within the tube interior, the exhaust flow modification structure having an outer surface spaced from the tube whereby the tube and the exhaust flow modification structure define an exhaust gas flow path surrounding the outer surface.

The exhaust flow modification structure is configured to produce a laminar flow of the exhaust gas and to modify flow speed of the exhaust gas due to the venturi effect within the tube interior.

The exhaust flow modification structure defines an internal exhaust gas flow passageway through which a portion of the exhaust gas in said tube interior flows during operation of the internal combustion engine, said internal exhaust flow passageway configured to modify flow speed of the portion of exhaust gas due to the venturi effect. The exhaust flow modification structure includes a first structural component and second structural component. The first structural component has an inner surface defining the internal exhaust gas flow passageway, the inner surface configured to form an internal venturi having a converging inlet nozzle portion, a diverging outlet diffuser portion and a gas flow restricting throat portion interconnecting the converging inlet nozzle portion and the diverging outlet diffuser portion. The second structural component comprises a double-ended member having a smoothly curved outer surface projecting outwardly from said converging inlet nozzle portion and defining an annular airflow space therewith for enhancing the venturi effect of the flow modification structure.

Other features, advantages and objects of the present invention will become apparent with reference to the following description and accompanying drawings.

MODES FOR CARRYING OUT THE INVENTION

Figure 1:
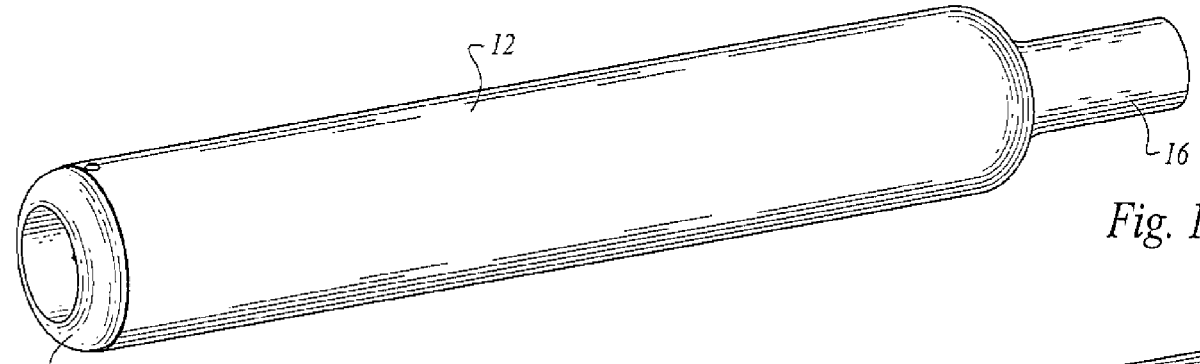
FIG. 1 is a perspective view illustrating a first embodiment of apparatus constructed in accordance with the teachings of the present invention.
Figure 2:
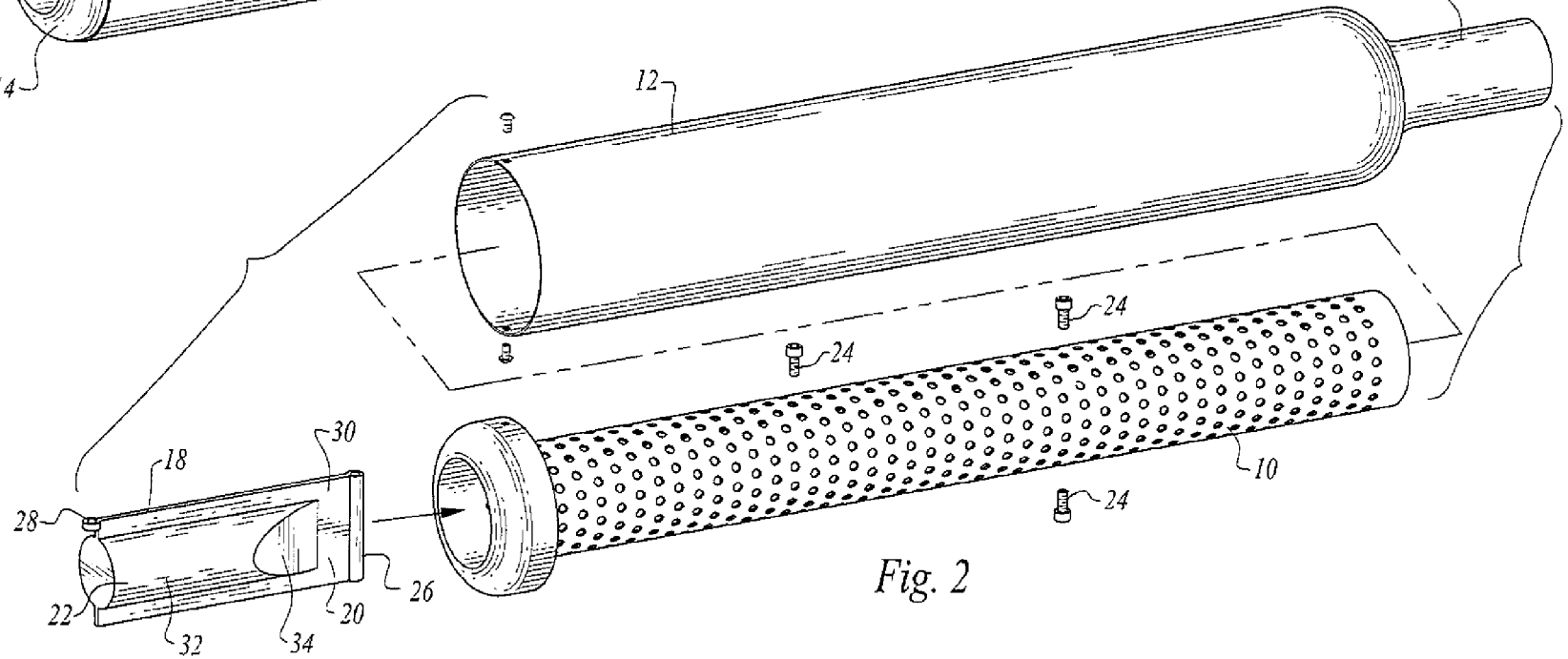
FIG. 2 is an exploded, perspective view illustrating components of the apparatus shown in FIG. 1 prior to assembly.

FIGS. 1-8 illustrate a first embodiment of apparatus constructed in accordance with the teachings of this invention. The apparatus includes an elongated, perforated baffle tube 10 which is positionable in a muffler shell 12. This combination of structural elements is well known in the muffler and exhaust arts. An end cap 14 of the baffle tube is held in place relative to the muffler shell by screws or other suitable connector means.

The baffle tube 10 defines a tube interior for receiving exhaust gas from an internal combustion engine (not shown) through an exhaust entry pipe 16 of the muffler shell.

Prior to assembly of the baffle tube and the muffler shell, an exhaust flow modification structure 18 is inserted into the interior of the baffle tube. The exhaust flow modification structure 18 includes a front end portion 20 and a rear end portion 22. Pins 24 or other suitable mechanical connectors are utilized to secure the exhaust flow modification structure in place within the baffle tube interior, the pins positioned in receivers 26, 28 at the front end portion and rear end portion, respectively. Receivers 26, 28 are integrally attached to a centrally disposed plate-like mounting member 30 extending along the primary axis of the baffle tube.

The rear end portion 22 has an elongated rounded hemispherical shaped outer surface 32 projecting from each side of plate-like mounting member 30. The rear end portion is of generally uniform size and configuration. Front end portion 20, on the other hand, gradually increases in size in the direction of the rear end portion. More particularly, opposed beveled surfaces 34 extend from the sides of the plate-like mounting member 30 to the rounded surfaces 32 of the rear end portion.

Figures 3, 4, 5, 6, 7, 8:
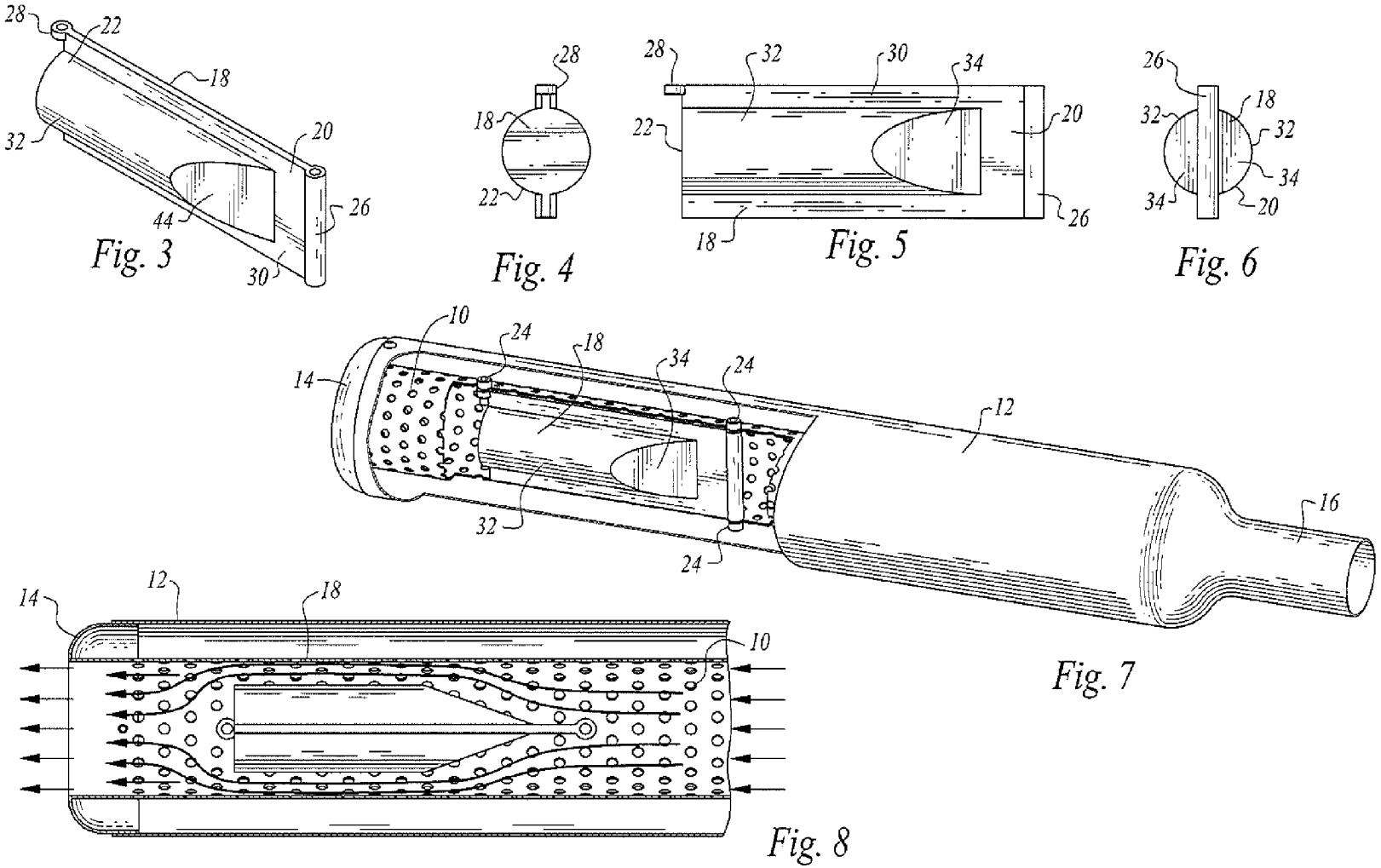
FIG. 3 is a perspective view of the exhaust flow modification structure of the apparatus.
FIG. 4 is an elevational view of the rear end portion of the exhaust flow modification structure.
FIG. 5 is a side, elevational view of the exhaust flow modification structure.
FIG. 6 is an elevational view of the front end portion of the exhaust flow modification structure.
FIG. 7 is a perspective view of the apparatus having a portion thereof broken away to show the exhaust flow modification structure inserted into and connected to a baffle tube, the baffle tube being disposed within a muffler shell.
FIG. 8 is a cross-sectional view providing a diagrammatic representation of exhaust flow within the baffle tube interior and around the exhaust flow modification structure.

FIG. 8 illustrates by arrows the flow of exhaust gas through baffle tube 10 and how such flow is modified as the exhaust gas flows through the exhaust gas flow path formed between the outer surface of the exhaust flow modification structure and baffle tube, such exhaust gas flow path surrounding the exhaust flow modification structure outer surface.

The outer surface is configured to produce a laminar flow of the exhaust gas and also to modify flow speed of the exhaust gas due to the venturi effect within the baffle tube interior. This results in a reduction of turbulence in the exhaust gas and in a reduction of back pressure inhibiting flow of exhaust gas into and through the interior of the perforated baffle tube.

The exhaust flow modification structure may be one of a plurality of exhaust flow modification structures selectively alternatively releasably connected to the baffle tube, the exhaust flow modification structures having different physical and performance characteristics, one or several of which may be more applicable for use than others in a particular exhaust system environment.

FIGS. 9-14 illustrate a second embodiment of the invention and wherein like reference numbers are employed when the structural components are the same as that of the first embodiment.

In this second embodiment the only structural element change is with respect to the exhaust flow modification structure, identified in this embodiment by reference numeral 40. Rather than utilize opposed planar beveled surfaces to provide an interface between the elongated rounded outer surfaces of the rear end portion of this embodiment, the transition from the plate-like mounting member to the elongated rounded surfaces is by a hemi-conical surface 42 on each side of the mounting member.

Figures 9, 10, 11, 12, 13, 14:
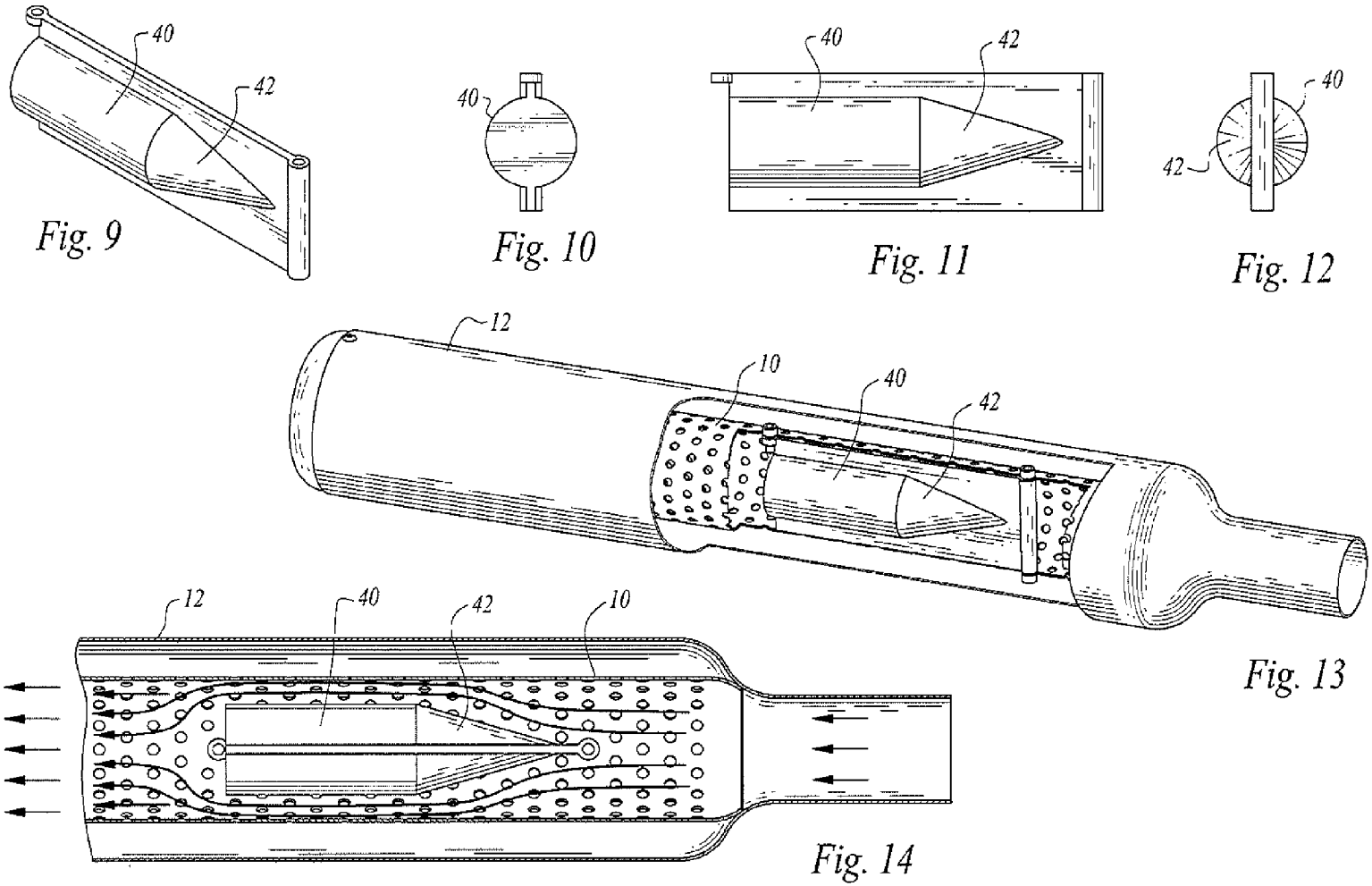
FIG. 9 is a perspective view of a second embodiment of exhaust flow modification structure.
FIG. 10 is an elevational view of the rear end portion of the exhaust flow modification structure of FIG. 9.
FIG. 11 is a side, elevational view of the exhaust flow modification structure of FIG. 9.
FIG. 12 is an elevational view of the front end portion of the embodiment of the exhaust flow modification structure of FIG. 9.
FIG. 13 is a view similar to FIG. 7, but illustrating the second embodiment of the exhaust flow modification structure in the baffle tube.
FIG. 14 is a view similar to FIG. 8, but illustrating the exhaust flow modification structure of FIG. 9 and exhaust flow.

FIG. 14 illustrates the flow of exhaust gases through baffle tube 10 and around exhaust flow modification structure 40. This arrangement, like that of the first embodiment, results in modification of the exhaust flow by producing a laminar flow of the exhaust gas and by modifying the flow speed of the exhaust gas due to the venturi effect within the tube interior.

FIGS. 15-21 disclose a third embodiment wherein all structural components previously described are the same except for the exhaust flow modification structure, which in this third embodiment is identified by reference numeral 50. In this embodiment exhaust flow modification structure 50 includes a front end portion 52 having a hemi-conical outer surface. Rear end portion 54 has a cylindrically-shaped outer surface.

Figures 15, 16, 17, 18, 19, 20, 21, 22:
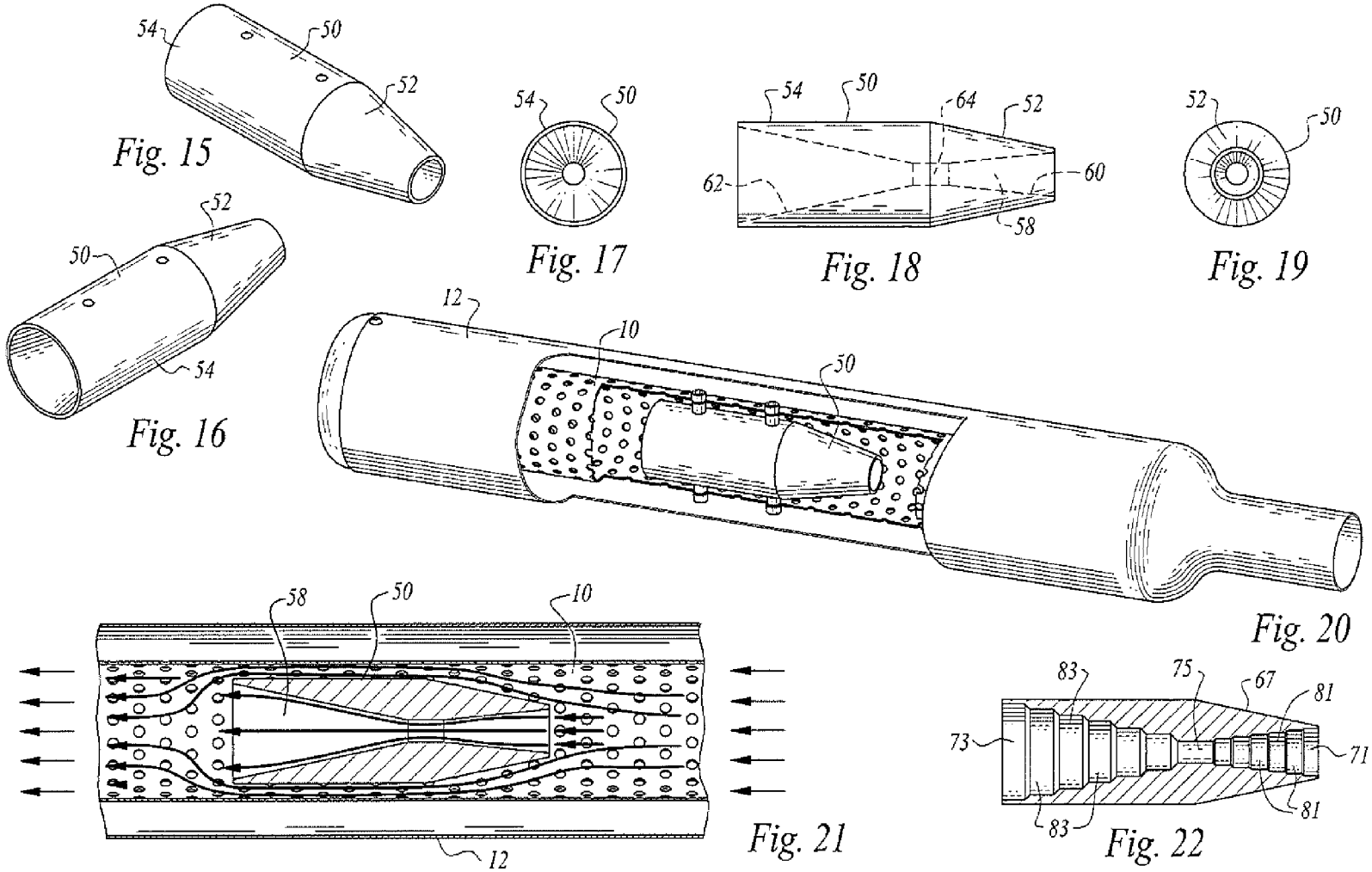
FIG. 15 is a front, perspective view of a third embodiment of exhaust flow modification structure.
FIG. 16 is a rear, perspective view of the third embodiment of exhaust flow modification structure.
FIG. 17 is an elevational view of the rear end portion of the third embodiment of exhaust flow modification structure.
FIG. 18 is a side, elevational view of the third embodiment of the exhaust flow modification structure and illustrating with dash lines the configuration of an inner venturi exhaust flow path formed thereby.
FIG. 19 is an elevation view of the front end portion of the third embodiment of exhaust flow modification structure.
FIG. 20 is a view similar to FIGS. 7 and 13, but illustrating the third embodiment of exhaust flow modification structure within and connected to the system baffle tube.
FIG. 21 is a view similar to FIGS. 8 and 14, but illustrating the third embodiment of exhaust flow modification structure within the baffle tube and utilized to modify exhaust gas flow.
FIG. 22 is a side, elevational, cross-sectional view of a fourth embodiment of exhaust flow modification structure.
Figure 24:
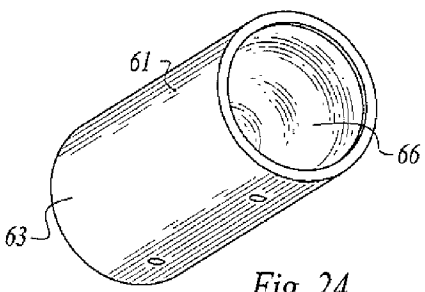
FIG. 24 is a rear, perspective view of the fifth embodiment of exhaust flow modification structure.
Figure 23:
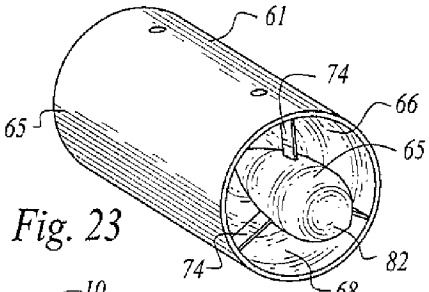
FIG. 23 is a front, perspective view of a fifth embodiment of exhaust flow modification structure.
Figure 25:
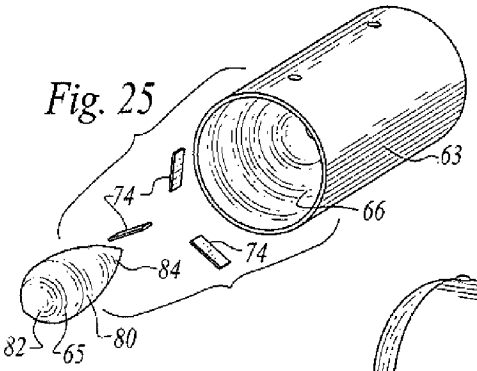
FIG. 25 is an exploded, perspective view illustrating components of the fifth embodiment of exhaust flow modification structure prior to assembly.
Figure 26:
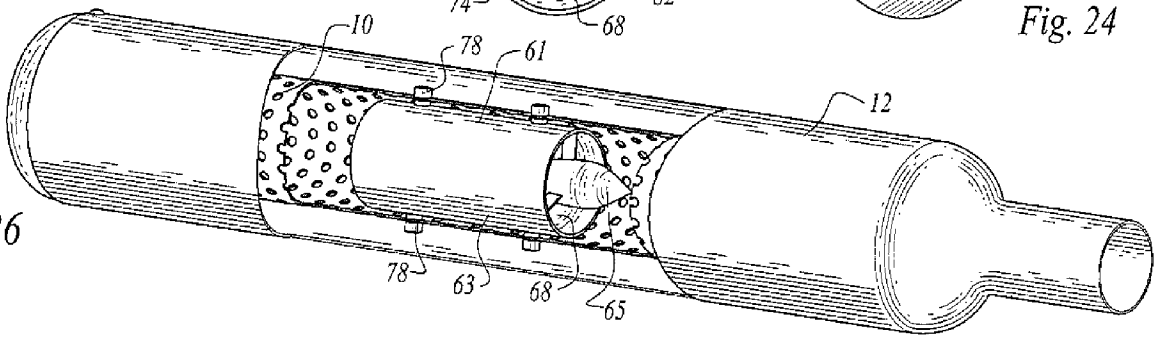
FIG. 26 is a view similar to FIGS. 7, 13 and 20, but illustrating the fifth embodiment of exhaust flow modification structure within and connected to the system baffle tube.

Exhaust flow modification structure 50 defines an internal exhaust gas flow passageway 58 deformed by an inner surface configured to form an internal venturi having a converging inlet nozzle portion 60, a diverging outlet diffuser portion 62 and a gas flow restricting throat portion 64 interconnecting the converging inlet nozzle portion and the diverging outlet diffuser portion (see FIG. 18).

FIG. 21 illustrates the exhaust flow modification structure 50 in place within baffle tube 10, exhaust gas flow illustrated by arrows. As may be seen with reference to this latter figure, a portion of the exhaust gas in the baffle tube interior flows through internal gas flow passageway 58 which is configured to modify the flow speed of that portion of the exhaust gas due to the venturi effect.

At low velocities, the inner venturi causes pressures at the inlet of the venturi to increase the fluid acceleration around the front of the exhaust flow modification structure, aiding low-end torque. At mid to high velocities the venturi converts the pressure energy at the inlet into velocity energy creating a low-pressure or vacuum shown both through the exhaust flow modification structure and around the back thereof, aiding in both peak torque and top RPM performance of the internal combustion engine associated with the system.

FIG. 22 illustrates yet another embodiment 67 of exhaust flow modification structure which also incorporates an inner venturi. In this instance the venturi has been designed with multiple stages to further improve efficiency.

Exhaust flow modification structure 67 incorporates a converging inlet nozzle portion 71, a diverging outlet diffuser portion 73 and a gas flow restricting throat portion 75. The inner surface of the internal exhaust gas flow passageway has a plurality of interconnected inner surface portions of different diameters at the inlet nozzle portion and at the outlet diffuser portion creating a multi-stage venturi. Some of the inner surface portions of the inlet nozzle portion are identified by reference numeral 81 and some of the inner surface portions of the outlet diffuser portion are identified by reference numeral 83.

Tests indicate that the multi-stage type venturi generates a wider range of higher pump/vacuum rates and velocities compared to the single-stage type venturi. Similar in effect to a multi-stage ejector, the multi-stage venturi is beneficial for exhaust applications which benefit from high operational efficiency in the presence of fluctuating compressible-gas (fluid) pressures occurring at varying RPM's.

FIGS. 23-27 illustrate another embodiment of the invention, exhaust flow modification structure of this embodiment being designated by reference numeral 61. Exhaust flow modification structure 61 includes a first structural component 63 and a second structural component 65.

First structural component 63 has an inner surface 66 defining an internal exhaust gas flow passageway. The inner surface is configured to form an internal venturi having a converging inlet nozzle portion 68, a diverging outlet diffuser portion 70 and a gas flow restricting throat portion 72 interconnecting the converging inlet nozzle portion and the diverging outlet diffuser portion.

The second structural component 65 is in the form of a double-ended member having a smoothly curved outer surface. The double-ended member is connected to the first structural component by connectors 74 and projects outwardly from the converging inlet nozzle portion to define an annular air flow space 76 therewith. The outer surface of the first structural component is connected to baffle tube 10 by connectors 78. An elongated annular air flow space is formed along and between the baffle tube and the first structural component.

The double-ended member 65 includes a central segment 80 and two opposed end segments 82, 84 internal with or otherwise affixed to the central segment. The end segments taper in opposite directions away from the central segment. The second structural component or double-ended member 65 projects outwardly from the converging inlet nozzle portion of first structural component 63 and defines the annular air flow space 76 therewith for enhancing the venturi effect caused by the flow modification structure.

In this embodiment, both of the end segments taper to a point. The point of end segment 84 is in close proximity to the gas flow restriction throat portion 72. The double-ended member 65 is elongated, has an outer peripheral surface with a circular cross-sectional configuration along the length thereof, and is co-axial with the baffle tube 10 as well as with the first structural component 63. It has been found that the arrangement of this embodiment enhances and supplements the venturi effect. Arrows in FIG. 27 show air flow between the first and second structural components as well as the enhanced air flow through the venturi defined by the first structural component and between first structural component 62 and the baffle tube.

Figure 28:
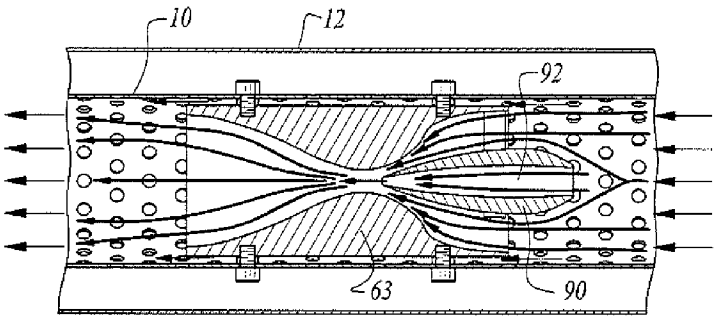
FIG. 28 is a view similar to FIGS. 8, 14, 21 and 27, but illustrating a sixth embodiment of exhaust flow modification structure within the baffle tube and utilized to modify exhaust gas flow.
Figure 27:
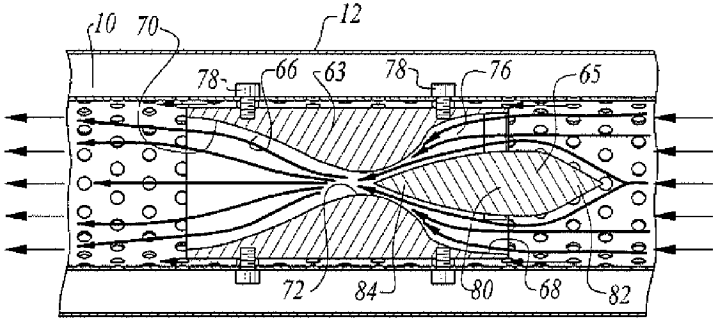
FIG. 27 is a view similar to FIGS. 8, 14 and 21, but illustrating the fifth embodiment of exhaust flow modification structure within the baffle tube and utilized to modify exhaust gas flow.

FIG. 28 is a view similar to FIG. 27 illustrating yet another embodiment of the invention. This embodiment differs from the embodiment of FIGS. 23-27 in that the central segment and the end segments of the double-ended member 90 is not pointed at the ends. Instead, the central segment and end segments thereof define a throughbore 92 communicating with the internal exhaust flow passageway of the first structural component 62 at the gas flow restricting throat portion thereof. In this embodiment, as is the case in the previously described embodiment of FIGS. 23-27, the annular air flow space defined by the first structural component and the second structural component becomes increasingly constricted in the direction of the gas flow restricting throat portion.

The present invention is not limited to the disclosed embodiments thereof and changes can be made without departing from the spirit or scope of the invention. For example, the exhaust flow modification structure is not limited to the specific configurations disclosed and the exhaust flow modification structure can be fixed in place rather than added as an insert. The principles of the invention may be applied to a non-perforated tube rather than to a perforated baffle tube and the tube may or may not be placed within a muffler shell.

The invention claimed is:

1. An exhaust system for an internal combustion engine, said exhaust system comprising, in combination:

an elongated tube defining a tube interior for receiving exhaust gas from the internal combustion engine; and exhaust flow modification structure within said tube interior having an outer surface spaced from said tube whereby said tube and said exhaust flow modification structure define an exhaust gas flow path surrounding said outer surface, said exhaust flow modification structure configured to produce a laminar flow of said exhaust gas and to modify flow speed of said exhaust gas due to the venturi effect within said tube interior, said exhaust flow modification structure defining an internal exhaust gas flow passageway through which a portion of the exhaust gas in said tube interior flows during operation of the internal combustion engine, said internal exhaust flow passageway configured to modify flow speed of the portion of exhaust gas due to the venturi effect, and said exhaust flow modification structure including a first structural component and second structural component, said first structural component having an inner surface defining said internal exhaust gas flow passageway, said inner surface configured to form an internal venturi having a converging inlet nozzle portion, a diverging outlet diffuser portion and a gas flow restricting throat portion interconnecting said converging inlet nozzle portion and said diverging outlet diffuser portion, and said second structural component comprising a double-ended member having a smoothly curved outer surface projecting outwardly from said converging inlet nozzle portion and defining an annular airflow space therewith for enhancing the venturi effect of the flow modification structure.

2. The exhaust system according to claim 1 wherein double-ended member includes a central segment and two opposed end segments affixed to the central segment, said end segments tapering in opposite directions away from said central segment.

3. The exhaust system according to claim 1 wherein at least one of said end segments tapers to a point.

4. The exhaust system according to claim 3 wherein the point of one of said end segments is in close proximity to said gas flow restriction throat portion.

5. The exhaust system according to claim 2 wherein said double-ended member is elongated, has an outer peripheral surface with a circular cross-sectional configuration along the length thereof, and is substantially co-axial with the elongated tube.

6. The exhaust system according to claim 1 wherein said tube is a baffle tube positionable in a muffler shell.

7. The exhaust system according to claim 6 wherein said baffle tube is perforated.

8. The exhaust system according to claim 2 wherein said exhaust flow modification structure is elongated and wherein said central segment and said end segments define a through-bore communicating with the internal exhaust flow passageway at or closely adjacent to said gas flow restricting throat portion.

9. The exhaust system according to claim 1 additionally comprising connector structure connecting said first structural component to said elongated tube.

10. The exhaust system according to claim 1 additionally comprising connector structure connecting said second structural component to said first structural component.

11. The exhaust system according to claim 1 wherein the annular airflow space defined by said first structural component and said second structural component becomes increasingly constricted in the direction of said gas flow restricting throat portion.

* * * * *